US005203462A

United States Patent [19]

Brooks

[11] Patent Number: 5,203,462

[45] Date of Patent: Apr. 20, 1993

[54] SPORTS EQUIPMENT RACK

[76] Inventor: Cary W. Brooks, 20360 Oneida Dr., Mt. Clemens, Mich. 48044

[21] Appl. No.: 738,261

[22] Filed: Jul. 31, 1991

[51] Int. Cl.[5] ..... A47F 7/00

[52] U.S. Cl. ..... 211/14; 211/87; D6/552

[58] Field of Search ..... 211/13, 14, 87, 94, 211/106, 181, 32; 248/315, 302, 249; 273/25, 60 R, 1.5 R, 1.5 A, 459; 206/315.9; D6/552

[56] References Cited

U.S. PATENT DOCUMENTS

| | | | |
|---|---|---|---|
| D. 242,097 | 11/1976 | O'Neal | D6/552 |
| D. 248,809 | 8/1978 | Kailey | D6/552 |
| 116,561 | 7/1871 | Collender | 211/14 |
| 846,758 | 3/1907 | Pike | 211/106 X |
| 1,249,716 | 12/1917 | Calder | 211/14 X |
| 1,343,363 | 6/1920 | Hall | 211/106 X |
| 1,625,856 | 4/1927 | Judd | 211/14 |
| 1,703,547 | 2/1929 | Schmidt | 248/315 X |
| 1,858,299 | 5/1932 | Korn | 248/315 X |
| 2,553,764 | 5/1951 | Hawkins | 211/181 X |
| 2,628,804 | 2/1953 | Goodman | 248/315 X |
| 2,846,077 | 8/1958 | Kozub | 211/14 |
| 2,895,700 | 7/1959 | Johnson | 248/315 X |
| 3,381,824 | 5/1968 | Blumenschein | 211/14 |
| 4,002,241 | 1/1977 | Parrilla, Sr. | 211/14 X |

FOREIGN PATENT DOCUMENTS

| | | | |
|---|---|---|---|
| 272346 | 6/1927 | United Kingdom | 211/41 |

*Primary Examiner*—David A. Scherbel
*Assistant Examiner*—Derek J. Berger

[57] ABSTRACT

A sports equipment rack is disclosed comprising a ball holder having an arcuate region and a balancing leg extending from each end of the arcuate region and a means for securing the ball holder to a wall.

6 Claims, 2 Drawing Sheets

SPORTS EQUIPMENT RACK

FIELD OF THE INVENTION

The present invention relates to a sports equipment rack, and more preferably to a sports equipment rack for supporting large balls such as basketballs and soccer balls as well as baseball bats and baseball gloves.

BACKGROUND

Many have experienced the frustration associated with organizing a variety of sports balls such as basketballs or soccer balls in a single place so that they don't get lost or roll away. The present invention provides a sports equipment rack for organizing and storing in a single place a variety of large sports balls such as basketballs and soccer balls as well as baseball bats or gloves.

SUMMARY OF THE INVENTION

The present invention is directed to a sports equipment rack including a ball holder having an arcuate region and a balancing leg extending outwardly from each of the ends of the arcuate region and a means for securing the ball holder to a wall. Preferably, the radius of curvature of the arcuate region is less than the radius of the ball to be supported. The balancing legs each extending from a respective end of the arcuate region are spaced apart from each other a distance less than the diameter of the ball to be supported. Thus, when the ball is placed on the ball holder a portion of the ball extends through the space provided between the arcuate regions and the two balancing legs and so that the ball is supported at least by the two balancing legs and possibly by the arcuate region. The sports rack may include a plurality of these ball holders connected together by a variety of means and supported by a variety of means. In another embodiment the ball holder includes an arcuate region which closes on itself to form a loop having a substantially circular shape.

FIG. is an illustration of the sports equipment rack in partial view from a position underneath the ball that the rack supports.

Figure 3:
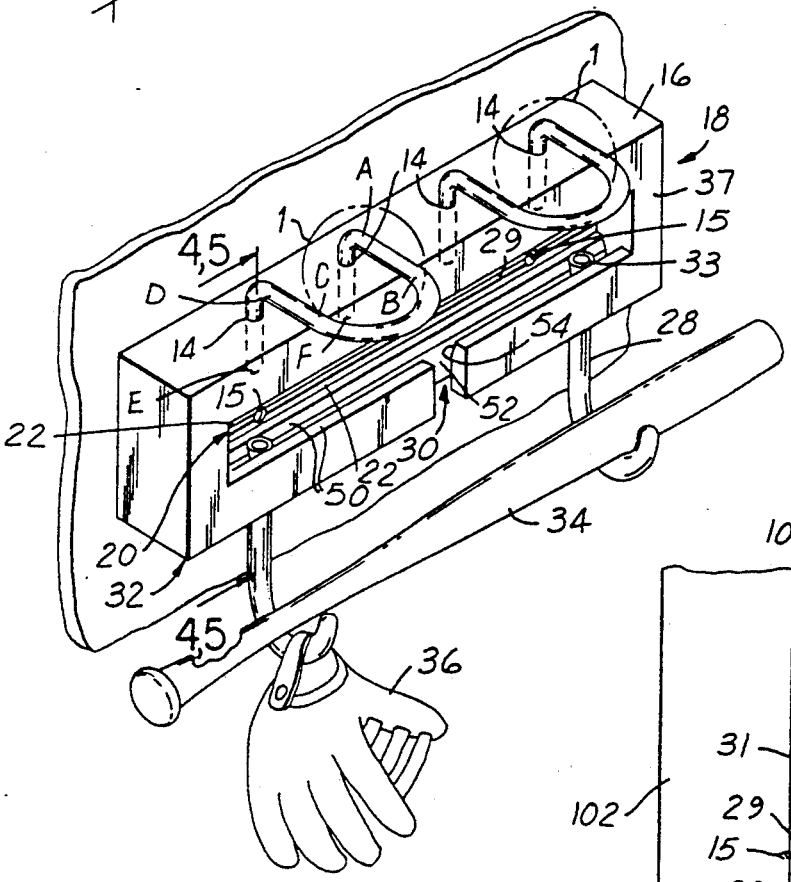

FIG. 3 is a perspective view of another embodiment of the present invention wherein the means for securing the ball holder to a wall is a support bar.

Figure 4:
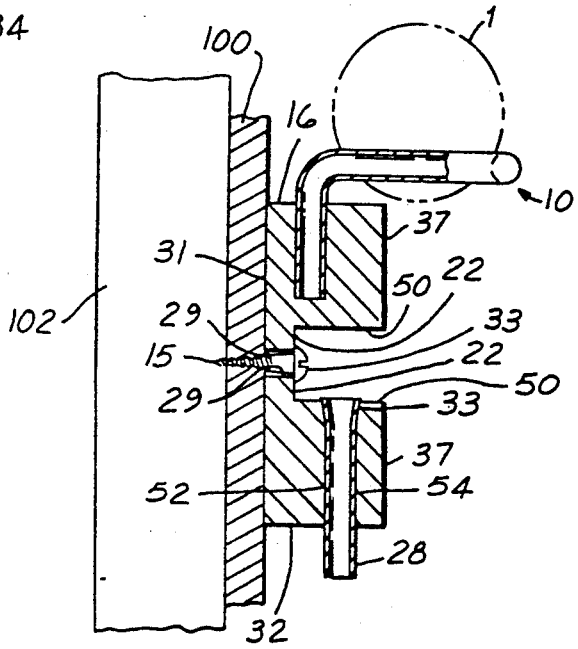

FIG. 4 is a partial sectional view of a sports equipment rack as shown in FIG. 3 along line 4—4 and wherein the ball holder is positioned substantially perpendicular to the wall.

Figure 5:
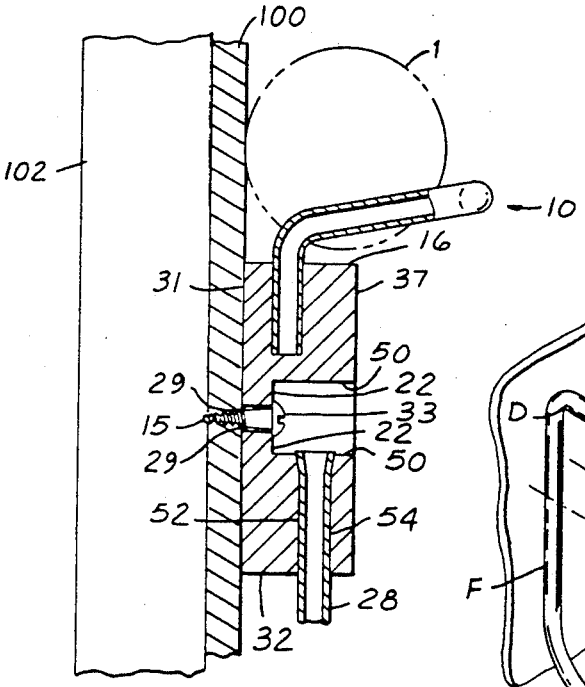

FIG. 5 is a partial sectional view of a sports equipment rack as shown in FIG. 3 along line 5—5 wherein the ball holder is angled less than 90 degrees with respect to the wall.

Figure 6:
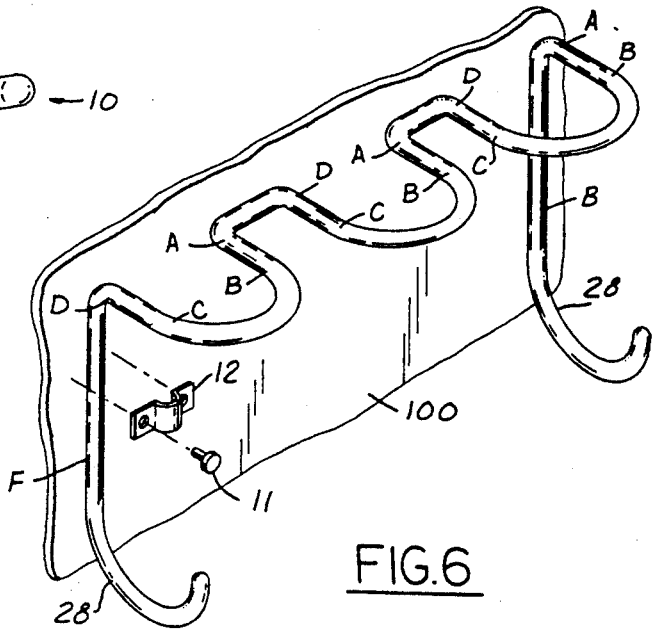

FIG. 6 is an illustration of another embodiment of the present invention wherein the ball holder and the support legs are formed from a single piece.

Figure 7:
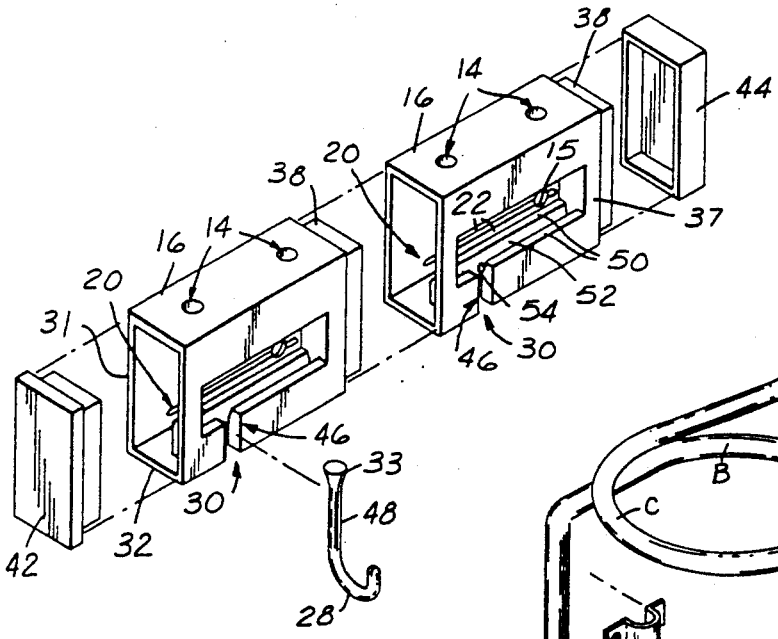

FIG. 7 is an illustration of a sectioned support bar of this invention in exploded view.

Figure 8:
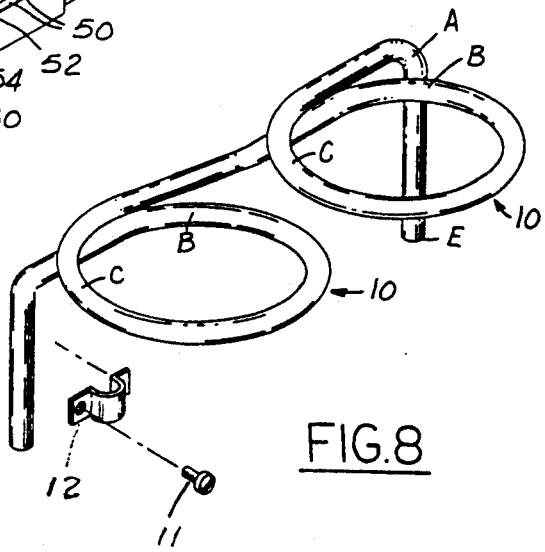

FIG. 8 is an illustration of another embodiment of the invention showing a ball holder having an arcuate region that closes on itself to form a substantially circular shape.

DETAILED DESCRIPTION

Figure 1:
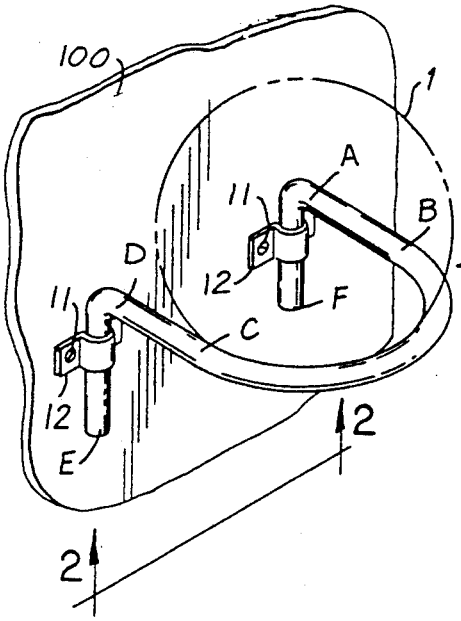
FIG. 1 is an illustration of a sports equipment rack according to the present invention having a ball holder and means for securing the holder to a wall.
Figure 2:
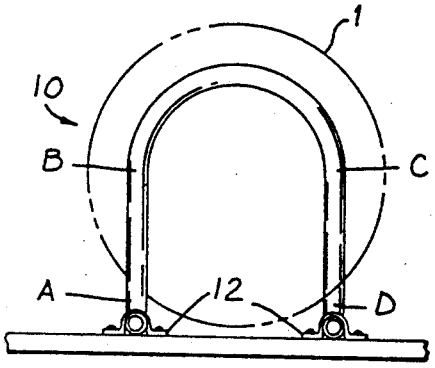

In one embodiment, as shown in FIG. 1, the sports equipment rack 10 includes the ball holder generally having a "U" shape. The rack includes the ball holder, defined by the structure between points A to D, and a support leg extending downward and generally perpendicular to each balancing leg, defined by the structure between points D–E and A–F, and a means for either fixedly securing or removable and adjustably securing the support leg to a wall, 100. The ball holder is designed to carry large balls 1 such as basketballs and soccer balls. The ball holder includes an arcuate region, defined by the structure extending between points B–C, and a balancing leg, defined by the structure extending between points A–B and C–D, extending from each end of the arcuate region. In some cases the support leg may be secured to the wall simply by a screw 11 or other means for fixedly securing the support leg. Another means for adjustably securing the support leg to the wall includes clips 12 as shown in FIG. 1.

FIG. 3 illustrates another embodiment of the present invention. In this embodiment the sports equipment rack includes a ball holder, defined by points A–D, having support legs defined by points A–F and D–E, extending downward from the balancing legs, defined by points A–C and E–D. The support legs are received in holes 14 formed in the top face 16 of a support bar 18 constructed and arranged to support the ball holder and any equipment resting thereon. The support bar may be secured to the wall by bolts 15 or other suitable means. In a preferred embodiment the support bar has a channel 20 formed therein through which a bolt 15 or wood screw may pass for slidably adjusting the position of the bolt.

As shown in FIG. 5, the channel may be defined by a pair of spaced apart walls 29 extending from a back face 31 of the support bar towards the front face 37. The channel may also be defined by pair of ridges 22 starting at the termination of the wall nearest the front face and extending toward the top face 16 and bottom face 32 respectively. The ridge acts as a stop for the head 24 of a bolt. The channel may also be defined by a pair of lips 50 extending inward from the front face 37 toward the back face 31 and terminating at a ridge 22. The bar may also include a hook 28 received in a hole 30 formed in the bottom face 32 (FIG. 3) of the support bar and secured in position by a screw or bolt, or by frictional fitting (not shown) or by a flared head 33 on the end of a tube. Preferably, at least two hooks are so secured to the support bar in a manner to carry a baseball bat 34. Each hook may be constructed and arranged to carry a baseball glove 36 as shown in FIG. 3.

The ball holders, support legs, and support bar may be constructed from wood or a ceramic, plastic or metal material. Preferably the ball holder and support legs are formed from a single piece of metal wire, rod or tubing. A suitable material includes rust resistant stainless steel rod or tubing, or coated tube such as ½X0.035 terne electric weld or brazed tube, typical of SAE J 526/527. A ball holder may be formed by bending a straight portion of rod, wire or tube to form the arcuate region. Preferably the arcuate region and the balancing legs are in substantially the same plane. The support legs may be formed in a similar fashion.

As shown in FIG. 4 the support legs may be received in a support bar and constructed and arranged such that the ball holder is perpendicular to the wall carrying the support bar. In this case the balancing legs support the ball and the arcuate region acts as a stop preventing the ball from rolling off the balancing legs. The arcuate region may also help to support the ball.

As shown in FIG. 5, the support legs may also be received in the support bar and the ball holder and support legs may be constructed and arranged such that the ball holder forms an angle slightly less than 90° with respect to the wall. In this embodiment, the ball is supported at least by the balancing legs and rests against the wall which carries the support bar.

In another embodiment, shown in FIG. 6 the sports equipment rack includes a single piece that forms at least two ball holders and wherein the means for securing them to the wall includes a support leg, defined by points A of one holder and D of an adjacent holder, bridging the balancing legs of each ball holder which are adjacently positioned to each other. The support leg may be secured to the wall by screw or bolt (not shown) extending there through or adjustably secured by clips as described above. Preferably at least one hook 28 may extend downward from one of the balancing legs to support and carry a baseball glove. Preferably at least two hooks each extending downward from two spaced apart balancing legs are included in the rack so as to support and carry a baseball bat.

The embodiment shown in FIG. 6, may be constructed and arranged such that the ball holders and support legs are positioned to accommodate the spacing of studs 102 which may support the wall. In a preferred embodiment, which accomplishes this objective, the balancing legs of an individual ball holder are spaced apart approximately 6 inches, and each support leg is approximately 6 inches long. Preferably, the space between the wall and furthest point on the arcuate region is approximately 8.5 inches.

Another embodiment of the invention is shown in FIG. 7 which includes a sectioned support bar 18. Each section may have a male member 38 and a female member 40 at opposite ends. Several sections may be coupled together by inserting the male member of one section into the female member of an adjacent section of the support bar. In a support bar including several coupled support bar section pieces, a male cap 42 and a female cap 44 may be coupled to the respective female and male members of opposite end support bar pieces. The support bar may have a recess 46 formed in the front face and communication with the channel for receiving the stem 48 portion of a hook. The hook may have a head 33 which rides on a support bar inner lip 50 which also defines the channel and prevents the hook from falling to the ground. Preferably, the hook is formed from a tube and the head is formed by flaring the straight end of the tube with a flaring tool. A second channel may be defined in the support bar by a pair of spaced apart walls 52 and 54 extending doward from the lip to the bottom face 32 so that the hook may be moved to various positions within the second channel.

Another embodiment of the invention in shown in FIG. 8 wherein the ball holder has an arcuate region, defined by the structure between points B–C of each holder 10, that closes on itself to provide a loop having a substantially circular shape. Like the other embodiments, support legs, defined by the structure between points D–E and A–F, extend from the arcuate region. The support legs may be secured to the wall by any of the means described above.

I claim:

1. A combination comprising: a sports equipment rack comprising at least a first and second adjacently positioned U-shaped hollow ball holders each for supporting a basketball and each comprising an arcuate shaped leg and first and second substantially straight balancing legs each having one end extending from an associated end of the arcuate shaped leg; said arcuate shaped leg and said balancing legs of both the first and second ball holder all being in substantially the same plane; said rack being secured to a wall by a securing means so that each ball holder formed by said arcuate shaped leg and said balancing legs is angled slightly less than ninety degrees with respect to a wall to which the rack is to be secure to, and a ball supported and balanced by said balancing legs of one of said ball holders and resting against the wall.

2. A combination as set forth in claim 1 further comprising:

a support leg extending between adjacent balancing legs of said first and second ball holders and in substantially the same plane as said adjacent balancing of said first and second ball holders.

3. A combination as set forth in claim 2 wherein said first and second ball holders are formed of a single piece of material.

4. A sports equipment rack comprising: first and second adjacently positioned ball holders for supporting a basketball each comprising an arcuate shaped leg and first and second substantially straight balancing legs each having one end extending from an associated end of the arcuate shaped leg, and a support leg extending between adjacent balancing legs of adjacently positioned ball holders; said arcuate shaped leg and said balancing legs all being in substantially the same plane; and a means for securing said rack to a wall; and further comprising at least two spaced apart hooks each extending downward from a support leg and constructed and arranged to carry a baseball bat.

5. A sports equipment rack as set forth in claim 4 wherein said means for securing the support leg to the wall is adjustable and comprises a clip.

6. A sports equipment rack as set forth in claim 4 wherein said first and second ball holders and said support leg are formed of a single piece of material.

* * * * *

UNITED STATES PATENT AND TRADEMARK OFFICE

CERTIFICATE OF CORRECTION

PATENT NO. : 5,203,462

DATED : April 20, 1993

INVENTOR(S) : Robert D. Brooks

It is certified that error appears in the above-identified patent and that said Letters Patent is hereby corrected as shown below:

On the cover page, in field 76, delete "Cary W. Brooks, 20360 Oneida Dr.,
Mt. Clemens, Mich. 48044"

and insert in place therof

—Robert D. Brooks
14579 Kerner
Sterling Hts., Michigan 48313 —.

Signed and Sealed this

Twenty-fifth Day of October, 1994

*Attest:*

Bruce Lehman

BRUCE LEHMAN

*Attesting Officer*

*Commissioner of Patents and Trademarks*